US006953920B2

(12) United States Patent
Jeon

(10) Patent No.: US 6,953,920 B2
(45) Date of Patent: Oct. 11, 2005

(54) COMBINATION MICROWAVE OVEN AND STEAMER

(75) Inventor: In Ki Jeon, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/768,084

(22) Filed: Feb. 2, 2004

(65) Prior Publication Data

US 2005/0040160 A1 Feb. 24, 2005

(30) Foreign Application Priority Data

Aug. 19, 2003 (KR) ..... 10-2003-0057231

(51) Int. Cl.[7] ..... H05B 6/80

(52) U.S. Cl. ..... 219/682; 219/731; 219/757; 219/401; 99/451; 126/21 A

(58) Field of Search ..... 219/682, 681, 219/757, 731, 401; 99/451, DIG. 14; 126/21 A

(56) References Cited

U.S. PATENT DOCUMENTS

| | | | | | |
|---|---|---|---|---|---|
| 4,477,705 | A | * | 10/1984 | Danley et al. | 219/731 |
| 5,525,782 | A | * | 6/1996 | Yoneno et al. | 219/682 |
| 6,730,895 | B2 | * | 5/2004 | Kim | 219/682 |
| 2004/0035860 | A1 | * | 2/2004 | Oh | 219/682 |
| 2004/0050840 | A1 | * | 3/2004 | Hahm et al. | 219/682 |
| 2004/0118836 | A1 | * | 6/2004 | Kim | 219/682 |

FOREIGN PATENT DOCUMENTS

JP 2001-355843 * 12/2001

* cited by examiner

*Primary Examiner*—Philip H. Leung
(74) *Attorney, Agent, or Firm*—Staas & Halsey LLP

(57) ABSTRACT

A microwave oven is capable of cooking food using steam produced in a cooking cavity. The microwave oven includes a cabinet in which a cooking cavity is defined. A microwave heating unit radiates microwaves into the cooking cavity. A steaming unit is provided on a predetermined position of the cabinet to define a cooking space, which is partitioned from the cooking cavity. A steam guide passage guides steam produced in the cooking cavity, into the steaming unit.

20 Claims, 3 Drawing Sheets

COMBINATION MICROWAVE OVEN AND STEAMER

CROSS-REFERENCE TO RELATED APPLICATIONS

This application claims the benefit of Korean Patent Application No. 2003-57231, filed Aug. 19, 2003 in the Korean Intellectual Property Office, the disclosures of which are incorporated herein by reference.

BACKGROUND OF THE INVENTION

1. Field of the Invention

The present invention relates, in general, to microwave ovens and, more particularly, to a microwave oven which is capable of steaming food.

2. Description of the Related Art

Generally, a microwave oven is an appliance which cooks food placed in a cooking cavity using microwaves radiated from a magnetron into the cooking cavity. Typically, an electric cooker cooks food by heating the surfaces of the food, but the microwave oven cooks the food by heating the interior of the food through a dielectric heating method. That is, when microwaves radiated from the magnetron of the microwave oven cause the molecules of moisture laden in the food to vibrate, frictional heat is generated within the food, thereby cooking the food.

However, the conventional microwave oven sometimes produces cooked food that is dried out because the food is cooked by frictional heat generated when microwaves radiated from the magnetron cause the molecules of moisture laden in the food to vibrate, so that moisture is removed from the food during the cooking process. The conventional microwave oven has another problem in that it is difficult to steam food, because water must be added to the food while the food is being cooked. Thus, although the microwave oven is widely used to cook food, a steaming apparatus is additionally required to steam food, thus inconveniencing a user.

SUMMARY OF THE INVENTION

Accordingly, it is an aspect of the present invention to provide a microwave oven capable of cooking food using steam that is produced in a cooking cavity.

It is another aspect of the present invention to provide a microwave oven that is capable of cooking food using steam, and cooking another food using microwaves at the same time.

Additional aspects and/or advantages of the invention will be set forth in part in the description which follows and, in part, will be obvious from the description, or may be learned by practice of the invention.

The above and/or other aspects are achieved by providing a microwave oven, including a cabinet in which a cooking cavity is defined, a microwave heating unit that radiates microwaves into the cooking cavity, a steaming unit on a predetermined position of the cabinet to define a cooking space partitioned from the cooking cavity, and a steam guide passage that guides steam produced in the cooking cavity, into the steaming unit.

The steaming unit may include a depression and a cover. The depression may be formed on an upper portion of the cabinet to have a predetermined depth to receive food. An interior of the depression communicates with the steam guide passage. The cover may cover an open upper portion of the depression.

The steaming unit may further include a food container and a food support plate. The food container may be removably set in the depression while containing the food therein. An opening may be provided at a sidewall of the food container to communicate with the steam guide passage. The food support plate may be provided in the food container to be spaced apart from a bottom of the food container, thus supporting the food thereon, with the steam circulating through the food support plate.

An electrical component area is provided in the cabinet and is partitioned from the cooking cavity. The microwave heating unit is installed in the electrical component area. A blowing unit is installed in the electrical component area to cool the microwave heating unit and to blow air into the cooking cavity. A hole may be provided on a partition wall which partitions the electrical component area from the cooking cavity. The hole thus circulates the air from the electrical component area into the cooking cavity by the blowing unit.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
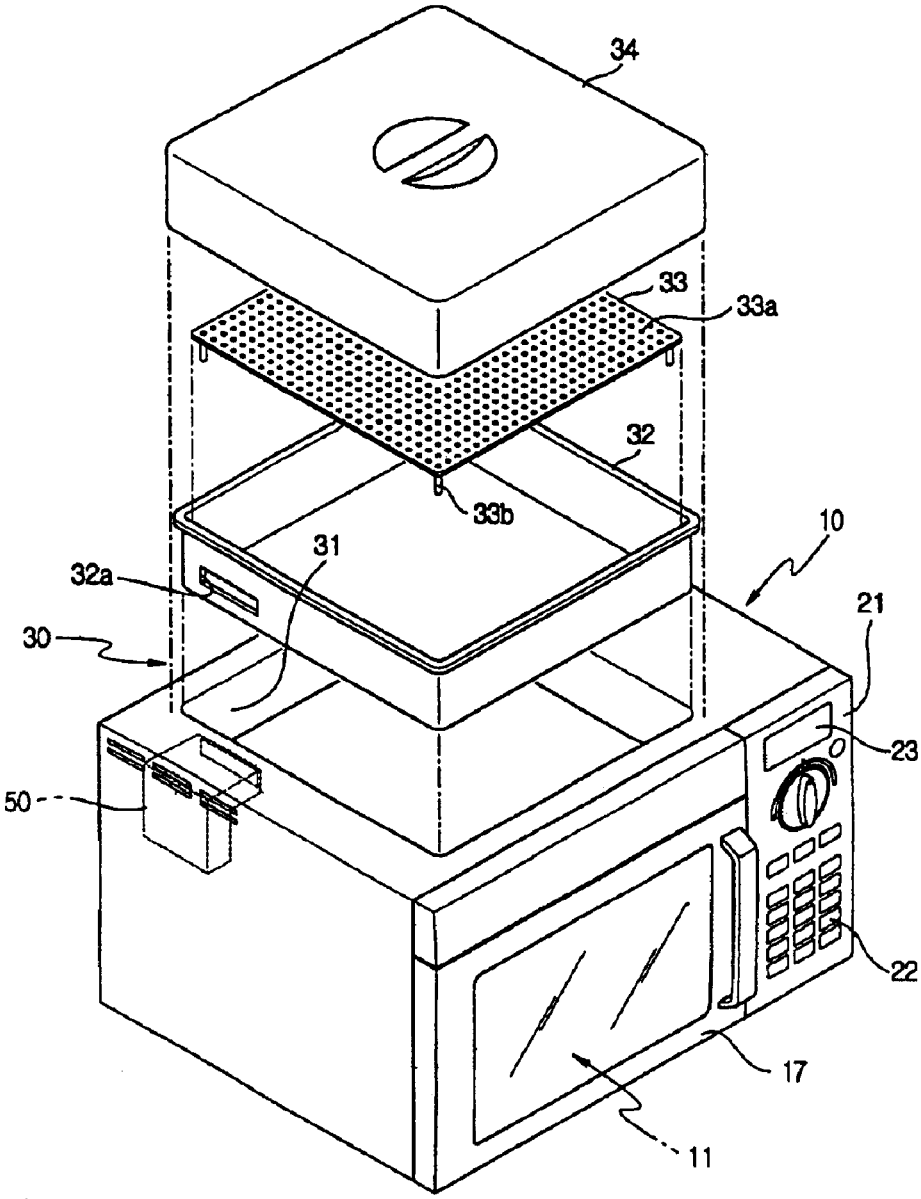
FIG. 1 is an exploded perspective view of a microwave oven, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
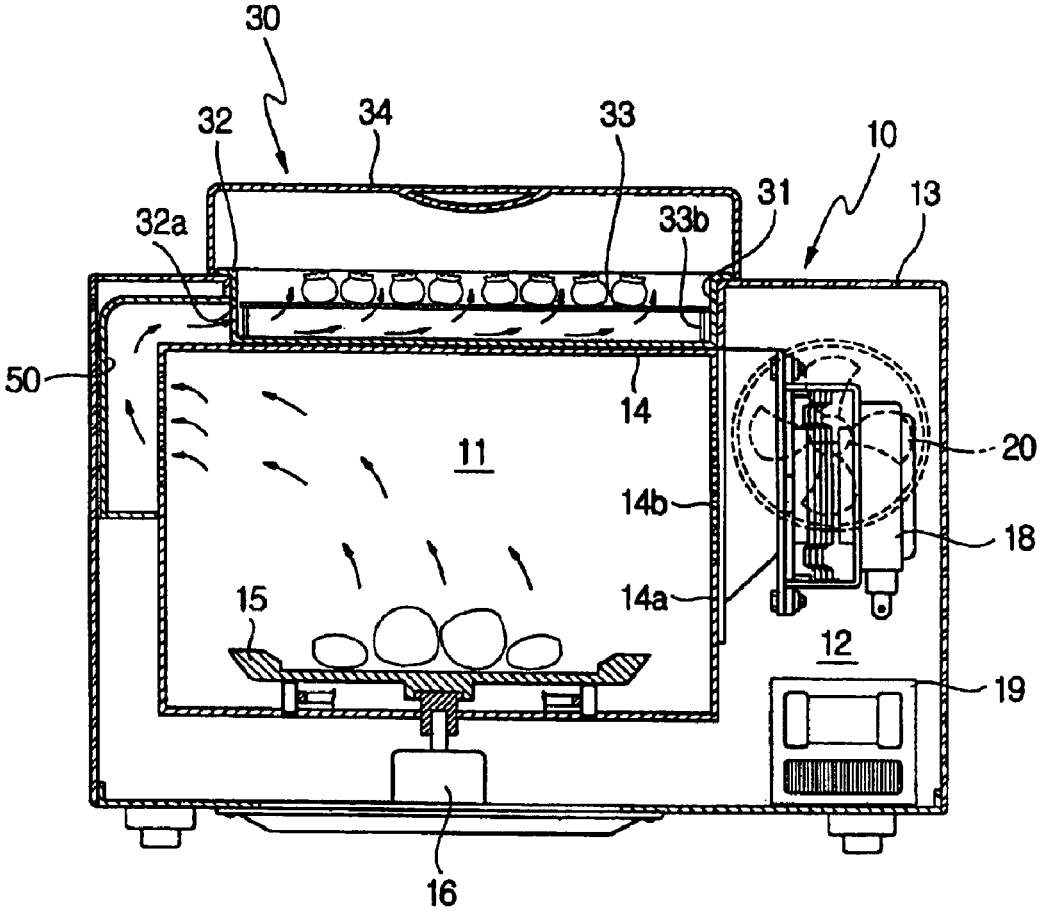
FIG. 2 is a sectional view of the microwave oven of FIG. 1, in which the microwave oven cooks food using microwaves, and cooks another food using steam, simultaneously.

As shown in FIGS. 1 and 2, a microwave oven, according to an embodiment of the present invention, includes a cabinet 10. The cabinet 10 is partitioned into a cooking cavity 11 and an electrical component area 12. Food to be cooked is placed in the cooking cavity 11. Several electrical devices for use in cooking are installed in the electrical component area 12. Further, the cabinet 10 is designed such that an inner casing 14 that defines the cooking cavity 11 is provided in an outer casing 13 that also houses the electrical component area 12. Thus, the cabinet 10 is partitioned into the cooking cavity 11 and the electrical component area 12.

A cooking tray 15 is rotatably mounted to a bottom of the cooking cavity 11. The food to be cooked is placed on the cooking tray 15 inside the cooking cavity 11. A motor 16 is installed in the space between the bottom of the cooking cavity 11 and the bottom of the outer casing 13 under the cooking cavity 11 to rotate the cooking tray 15. A door 17 is mounted to the front of the cooking cavity 11 to open or close the cooking cavity 11. A microwave heating unit, for example, a magnetron 18, is installed in the electrical component area 12 to radiate microwaves into the cooking cavity 11. A high-voltage transformer 19 is also installed in the electrical component area 12 to apply a high voltage to the magnetron 18 to generate the microwaves. Such a construction allows the food placed on the cooking tray 15 in the cooking cavity 11, to be cooked using the microwaves radiated from the magnetron 18. A blowing unit 20 is installed in the electrical component area 12 to cool the magnetron 18 and the high-voltage transformer 19, and to circulate air from the electrical component area 12 to the cooking cavity 11. As shown in FIG. 1, a control panel 21 is mounted to the front of the electrical component area 12, and is provided with a plurality of control buttons 22 to control the operations of the microwave oven and has a display 23 to display an operating state of the microwave oven.

The microwave oven is capable of conducting a steaming operation as well as the cooking operation using a microwave heating method. Thus, the microwave oven according to the present invention includes a steaming unit 30. The steaming unit 30 is provided on an upper portion of the cabinet 10 to steam food, using the steam, which is produced, in the cooking cavity 11. A steam guide passage 50 is provided on an upper portion of the cooking cavity 11 opposite to the electrical component area 12. The steam guide passage 50 functions to guide the steam from the cooking cavity 11 to the steaming unit 30.

The steaming unit 30 includes a depression 31, a food container 32, a food support plate 33, and a cover 34. The depression 31 is formed on the upper portion of the cabinet 10 to have a predetermined depth, and communicates with the steam guide passage 50 at a side of the depression 31. The food container 32 holds the food to be steamed and is removably seated in the depression 31. The food support plate 33 is set in the food container 32. The cover 34 covers the open top of the food container 32.

The food container 32 has a box shape which is open at the top. An opening 32*a* is provided on a sidewall of the food container 32 to communicate with the steam guide passage 50. It is beneficial to locate the opening 32*a* at a position that is higher than the bottom surface of the food container 32, thus preventing water and oil collected in the food container 32 during a steaming operation, from flowing into the steam guide passage 50.

A plurality of perforations 33*a* are formed on the food support plate 33 having a flat board shape, thus allowing the steam to pass through the food support plate 33 and condensation and oil to drip down into the food container 32. Further, a plurality of support legs 33*b* are provided on a lower surface of the food support plate 33 to support the food support plate 33 while being spaced apart from the bottom surface of the food container 32. Alternatively, a perforated tray (not shown) having a flange that engages an upper edge of the food container 32 may be used to support food above the bottom of the food container 32.

The operation and use of the microwave oven, according to an embodiment of the present invention will be described in the following.

When a user desires to cook food through the microwave heating method, the food is placed on the cooking tray 15 in the cooking cavity 11, and then the microwave oven is turned on. At this time, the microwaves are radiated from the magnetron 18 into the cooking cavity 11 to cook the food on the cooking tray 15.

Meanwhile, when both the cooking operation using the microwave heating method and the steaming operation are executed simultaneously, food is placed on the cooking tray 15 in the cooking cavity 11, and another food is put into the steaming unit 30 on the upper portion of the cabinet 10. To steam the food, the food container 32 is seated in the depression 31 on the upper portion of the cabinet 10. The food support plate 33 is set in the food container 32. Thereafter, the food to be steamed is placed on the food support plate 33, and then the food container 32 is covered with the cover 34.

When the microwave oven is operated in such a state, the microwaves are radiated from the magnetron 18 into the cooking cavity 11, thus cooking the food placed on the cooking tray 15 in the cooking cavity 11, through the microwave heating method. While the food placed on the cooking tray 15 is heated, steam is produced. The steam is fed into the food container 32 of the steaming unit 30 through the steam guide passage 50. Because the food placed on the food support plate 33 of the steaming unit 30 is heated by the steam fed from the cooking cavity 11, the food is steamed. For example, when potatoes are cooked in the cooking cavity 11 and frozen dumplings are steamed in the steaming unit 30, the steam produced in the cooking cavity 11 during cooking of the potatoes, is fed to the steaming unit 30, thus steaming the frozen dumplings. While food is cooked through the microwave heating method and another food is cooked using the steam, the blowing unit 20 installed in the electrical component area 12 is operated. Thus, the air circulates from the electrical component area 12, through a plurality of holes 14*b* of a partition wall 14*a*, which partitions the electrical component area from the cooking cavity 11, into the cooking cavity 11. Therefore, the steam produced in the cooking cavity 11 is smoothly guided to the steaming unit 30 through the steam guide passage 50 as the air and steam are circulated by the blowing unit 20.

Figure 3:
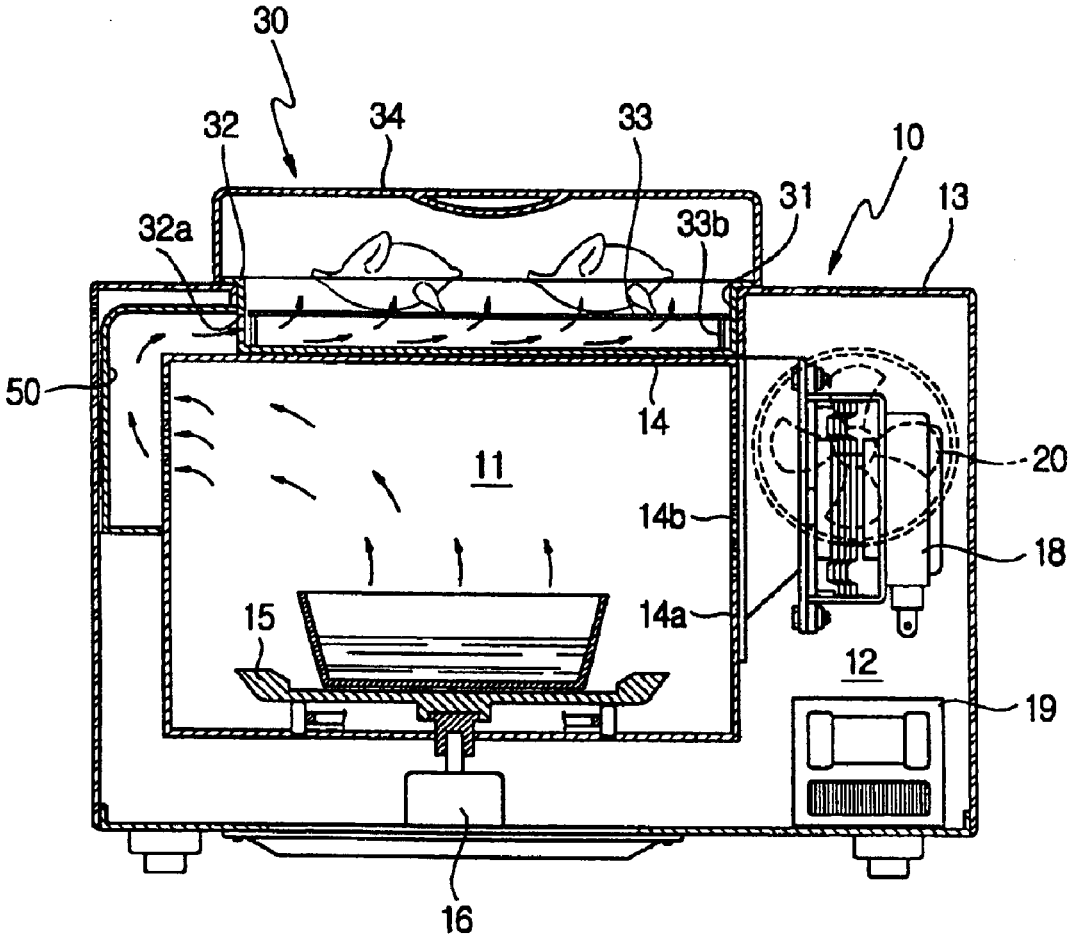
FIG. 3 is a sectional view of the microwave oven of FIG. 1, when the microwave oven executes only a steaming operation.

Further, when only the steaming operation is executed, as shown in FIG. 3, a container that contains water is put into the cooking cavity 11, and food to be steamed is put into the steaming unit 30 on the upper portion of the cabinet 10. Thereafter, the microwave oven is operated heating the water contained in the container to boiling, thus producing steam. The steam is fed into the steaming unit 30 through the steam guide passage 50, thus steaming the food contained in the steaming unit 30.

As is apparent from the above description, the present invention provides a microwave oven, which is capable of cooking food using steam fed from a cooking cavity into a steaming unit, and cooking another food through a microwave heating method.

Further, according to the present invention, the microwave oven is capable of simultaneously or separately executing a steaming operation and/or a cooking operation using the microwaves.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A microwave oven, comprising:

a cabinet in which a cooking cavity is defined;

a microwave heating unit to radiate microwaves into the cooking cavity;

a steaming unit provided on a predetermined position of the cabinet to define a cooking space which is separate from the cooking cavity; and a steam guide passage to guide steam produced in the cooking cavity, into the steaming unit.

2. The microwave oven according to claim 1, further comprising:

an electrical component area provided in the cabinet to be partitioned from the cooking cavity, with the microwave heating unit installed in the electrical component area; and a blowing unit installed in the electrical component area to cool the microwave heating unit and to blow air into the cooking cavity; and a hole provided on a partition wall which partitions the electrical component area from the cooking cavity, the hole thus circulating the air from the electrical component area into the cooking cavity by the blowing unit.

3. A microwave oven, comprising:

a cabinet in which a cooking cavity is defined;

a microwave heating unit to radiate microwaves into the cooking cavity;

a steaming unit provided on a predetermined position of the cabinet to define a cooking space which is partitioned from the cooking cavity;

a steam guide passage to guide steam produced in the cooking cavity, into the steaming unit;

a depression having a predetermined depth to receive food and formed on an upper portion of the cabinet wherein an interior of the depression communicates with the steam guide passage; and a cover to cover an open upper portion of the depression.

4. The microwave oven according to claim 3, wherein the steaming unit further comprises:

a food container removably set in the depression, with an opening provided at a sidewall of the food container to communicate with the steam guide passage; and a food support plate in the food container spaced apart from a bottom of the food container, wherein the food is supported, with the steam circulating through the food support plate.

5. A microwave oven comprising:

a cabinet having a cooking chamber, a machine room that contains a plurality of electrical components for use in cooking food in a cooking chamber;

a steamer defining a steaming chamber separate from the cooking chamber, the steamer disposed in the cabinet;

an exhaust path to exhaust steam from the cooking chamber to the steamer; and a blower fan assembly including a drive motor to create air flow through the cooking chamber and along the exhaust path to the steamer, wherein a first food item is cooked in the cooking chamber and a second food item is steamed in the steaming chamber.

6. The microwave according to claim 5, wherein the steamer comprises a food container coupled to the exhaust path; and a cover selectively engaging the food container.

7. The microwave according to claim 6, wherein the cooking chamber and the steamer operate simultaneously.

8. The microwave according to claim 6, wherein the food container further comprises a removable plate, having a plurality of perforations and a plurality of legs, in the food container to support food above a bottom of the food container.

9. The microwave according to claim 8, wherein the exhaust path is coupled to the food container in a side of the food container disposed above the bottom of the food container and below a bottom of the removable plate.

10. The microwave according to claim 6, wherein the food container further comprises a removable tray having a plurality of perforations, wherein a bottom of the tray is separated from a bottom of the food container.

11. The microwave according to claim 10, wherein the exhaust path is coupled to the food container in a side of the food container disposed above the bottom of the food container and below the bottom of the tray.

12. A microwave oven comprising:

a cabinet having a cooking chamber and a machine room that contains a plurality of electrical components for use in cooking food in a cooking chamber with microwave radiation;

a steamer integral with an upper portion of the cabinet; and an exhaust path to exhaust steam from the cooking chamber to the steamer;

wherein the steamer is separate from the cooking chamber.

13. The microwave according to claim 12, further comprising a blower fan assembly including a drive motor disposed in the machine room to create air flow through the cooking chamber and along the exhaust path to the steamer.

14. The microwave according to claim 12, wherein a first food is cooked with microwave radiation in the cooking chamber and a second food is cooked with steam, generated from the first food cooked in the cooking chamber, in the steamer.

15. A microwave oven comprising:

a cabinet having a cooking chamber and a machine room that contains a plurality of electrical components for use in cooking food in a cooking chamber with microwave radiation;

a steamer integral with an upper portion of the cabinet; and an exhaust path to exhaust steam from the cooking chamber to the steamer, wherein the steamer comprises:

a removable food container recessed in the upper portion of the cabinet coupled to the exhaust path; and a removable cover sealing the food container.

16. The microwave according to claim 15, wherein the exhaust path is coupled to the food container in a side of the food container.

17. The microwave according to claim 16, wherein the food container further comprises a removable plate having a plurality of holes and a plurality of supports in the food container to support food above a bottom of the food container.

18. The microwave according to claim 17, wherein the exhaust path is coupled to the food container in the side of the food container offset from the bottom of the food container and a bottom of the removable plate.

19. The microwave according to claim 16, wherein the food container further comprises a removable tray having a plurality of holes, wherein a bottom of the tray is offset from a bottom of the food container.

20. The microwave according to claim 19, wherein the exhaust path is coupled to the food container in a side of the food container offset from the bottom of the food container and the bottom of the tray.

* * * * *